United States Patent [19]

Ogami et al.

[11] Patent Number: 5,010,855

[45] Date of Patent: Apr. 30, 1991

[54] CAMSHAFT DRIVING ARRANGEMENT FOR DOUBLE OVERHEAD CAMSHAFT ENGINE

[75] Inventors: Etsuo Ogami, Yokohama; Yoshio Iwasa, Nagareyama, both of Japan

[73] Assignee: Nissan Motor Company, Ltd. of No. 2, Yokohama, Japan

[21] Appl. No.: 450,509

[22] Filed: Dec. 14, 1989

[30] Foreign Application Priority Data

Dec. 26, 1988 [JP] Japan ..... 63-326033

[51] Int. Cl.[5] ..... F01L 1/02; F02F 7/00

[52] U.S. Cl. ..... 123/90.31; 123/195 C; 123/198 E

[58] Field of Search ..... 123/90.27, 90.31, 195 C, 123/198 E

[56] References Cited

U.S. PATENT DOCUMENTS

| | | | |
|---|---|---|---|
| 4,553,473 | 11/1985 | Ichida et al. | 123/90.31 |
| 4,729,348 | 3/1988 | Okada et al. | 123/90.31 |
| 4,750,455 | 6/1988 | Ebesu | 123/90.31 |
| 4,867,335 | 9/1989 | Segal | 123/198 E |
| 4,883,031 | 11/1989 | Ampferer et al. | 123/195 C |

FOREIGN PATENT DOCUMENTS

| | | | |
|---|---|---|---|
| 0015612 | 1/1984 | Japan | 123/90.27 |
| 60-50208 | 3/1985 | Japan . | |
| 0208504 | 8/1989 | Japan | 123/90.31 |

*Primary Examiner*—Willis R. Wolfe
*Assistant Examiner*—Weilun Lo
*Attorney, Agent, or Firm*—Pennie & Edmonds

[57] ABSTRACT

In a DOHC engine, a sprocket chamber is formed at the cylinder head at one end thereof, and formed with a lateral opening. A timing chain drivingly interconnects a crankshaft and an idler gear, whereas a camshaft driving chain drivingly interconnects the idler gear and a pair of cam sprockets. A first tensioner is mounted to a cylinder block for adjusting the tension of the timing chain, whereas a second tensioner is mounted to the sprocket chamber for adjusting the tension of the camshaft driving chain. There are provided means for defining an access to the first tensioner.

4 Claims, 5 Drawing Sheets

CAMSHAFT DRIVING ARRANGEMENT FOR DOUBLE OVERHEAD CAMSHAFT ENGINE

This application is related to co-pending Application Ser. No. 07/498,245 which was filed Mar. 14, 1990.

BACKGROUND OF THE INVENTION

The present invention relates to a camshaft driving arrangement for a double overhead camshaft (DOHC) engine having two camshafts for intake and exhaust valves at each of cylinder heads.

Japanese Patent Publication No. 60-50208 discloses a camshaft driving arrangement of the prior art as shown in FIG. 6.

Referring to FIG. 6, there is shown a DOHC engine. A crankshaft 2 is rotatably mounted to the cylinder block 1 at the lower portion thereof. A crankshaft sprocket 3 is mounted to the crankshaft 2.

Rotatably mounted to the cylinder head 4 are an intake camshaft 5 for intake valves (not shown) and an exhaust camshaft 6 for exhaust valves (not shown). Camshaft sprockets 7A and 7B are fixedly mounted to the ends of the camshafts 5 and 6, respectively. An idler gear 8 is rotatably mounted to the cylinder head 4 at the lower portion thereof. The idler gear 8 is formed with a large diameter gear 8A and a small diameter gear 8B.

A timing chain 9 drivingly interconnects the large diameter gear 8A of the idler gear 8 and the crankshaft sprocket 3, whereas a camshaft driving chain 10 drivingly interconnects the small diameter gear 8B of the idler gear 8 and the camshaft sprockets 7A and 7B.

For adjusting the tension of the timing chain 9, a movable tensioner 13 is arranged to the cylinder block 1. The movable tensioner 13 includes an arm 11A which has one end swingably mounted to the cylinder block 1 and touches the timing chain 9, and a tensioner body 11C which is provided with a presser 11B for urging the other end of the arm 11A toward the timing chain 9. On the other hand, for adjusting the tension of the camshaft driving chain 10, a movable tensioner 12 is mounted to the cylinder head 4. Additionally, there are provided fixed tensioners 13 and 14 for the timing chain 9 and the camshaft driving chain 10, respectively.

With such conventional camshaft driving arrangement, since the movable tensioners 11 and 12 are concealed by covers (not shown) for the timing chain 9 and the camshaft driving chain 10, respectively, the movable tensioners 11 and 12 are difficult to adjust. Thus, problems are encountered such that, while predetermined values of tension are applied to the timing chains 9 and the camshaft driving chain 10 by the movable tensioners 11 and 12, respectively, it is difficult to mount and remove the camshafts 5 and 6, the chains 9 and 10, and the idler gear 8. This decreases their assembly efficiency.

An object of the present invention is to provide a camshaft driving arrangement wherein camshafts and an idler gear are easy to install and remove.

SUMMARY OF THE INVENTION

There is provided, according to the present invention, in a DOHC engine, the DOHC engine having a cylinder block including at least one cylinder bank, one cylinder head mounted on the cylinder bank, one pair of camshafts rotatably mounted on the cylinder head, and a crankshaft:

a pair of cam sprockets mounted to each of the camshafts at one end thereof;

a sprocket chamber formed at the cylinder head at one end thereof, said sprocket chamber being formed with a lateral opening, said sprocket chamber receiving said pair of cam sprockets;

an idler gear rotatably mounted to the cylinder head;

a timing chain drivingly interconnecting the crankshaft and said idler gear;

a camshaft driving chain drivingly interconnecting said idler gear and said pair of cam sprockets;

a first tensioner mounted to the cylinder block, said first tensioner adjusting the tension of said timing chain;

a second tensioner mounted to said sprocket chamber, said second tensioner adjusting the tension of said camshaft driving chain; and means defining an access to said first tensioner.

DETAILED DESCRIPTION OF THE INVENTION

Referring to FIGS. 1 to 4, a first preferred embodiment of the present invention will be described.

Figure 1:
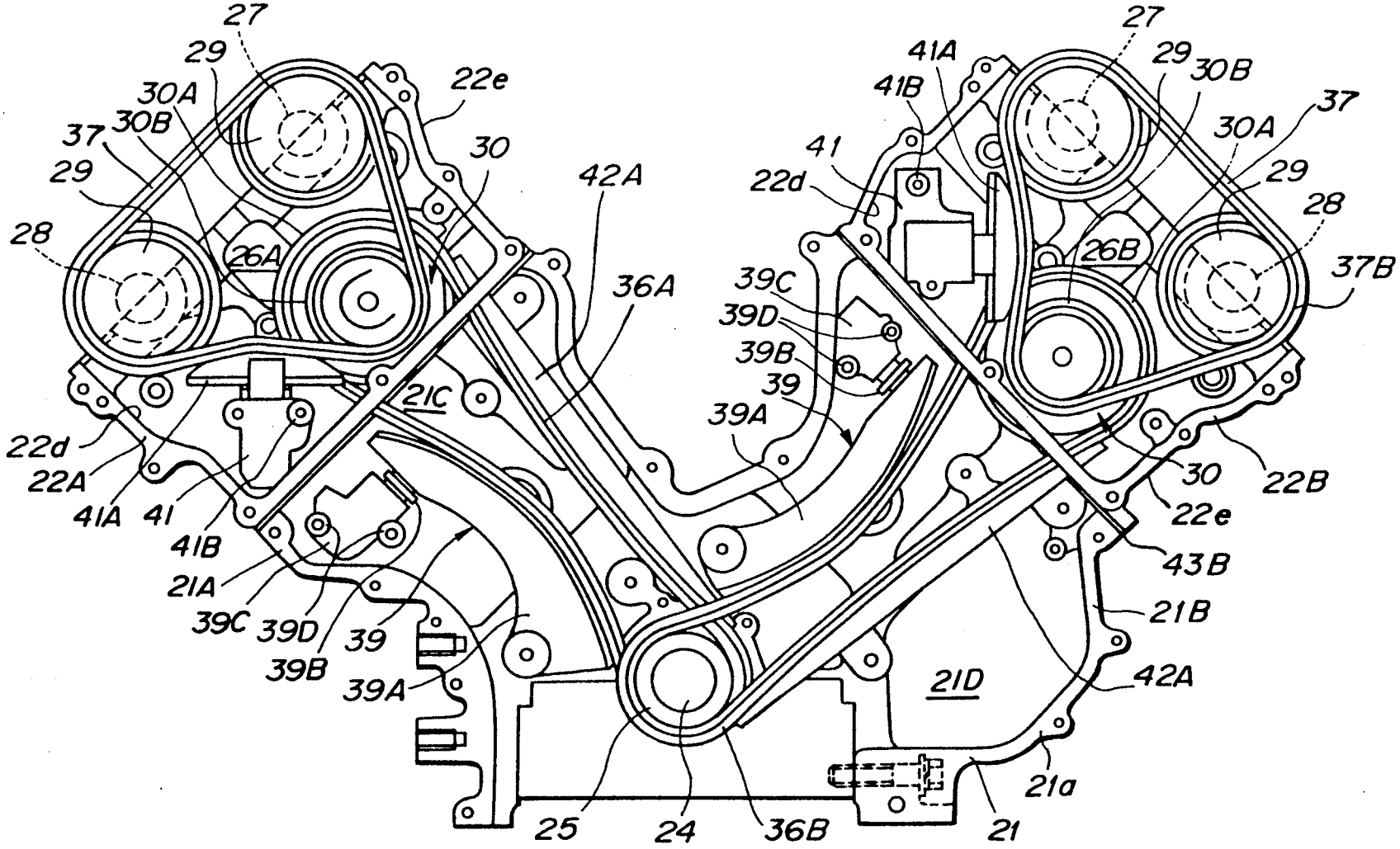
FIG. 1 is an axial end view of a V-type DOHC engine with unnecessary parts removed to show a camshaft driving arrangement.
Figure 2:
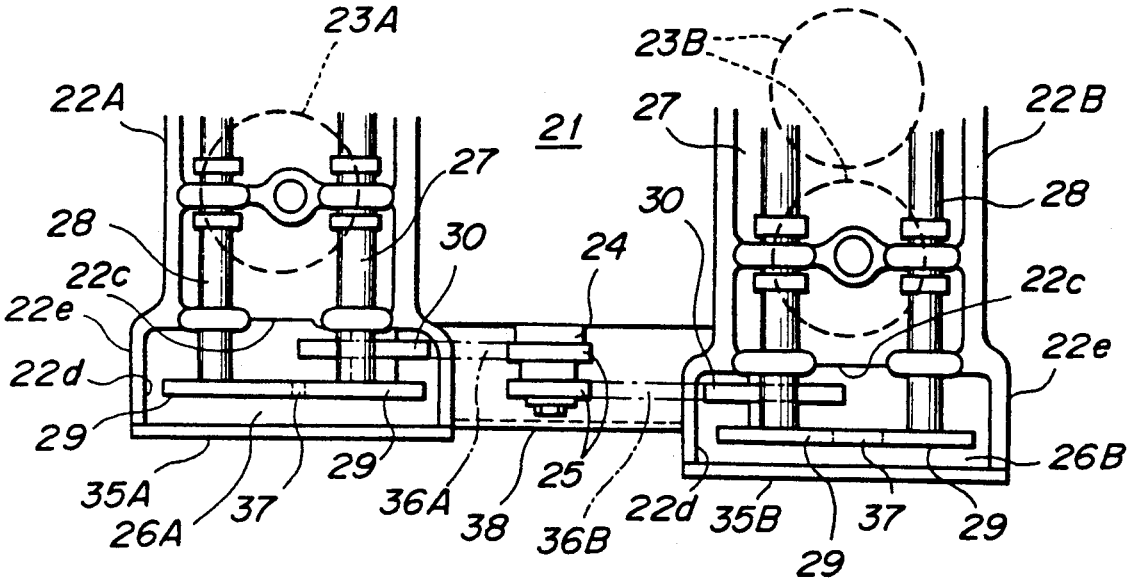
FIG. 2 is a diagrammatic view as viewed from the top in FIG. 1.
Figure 3:
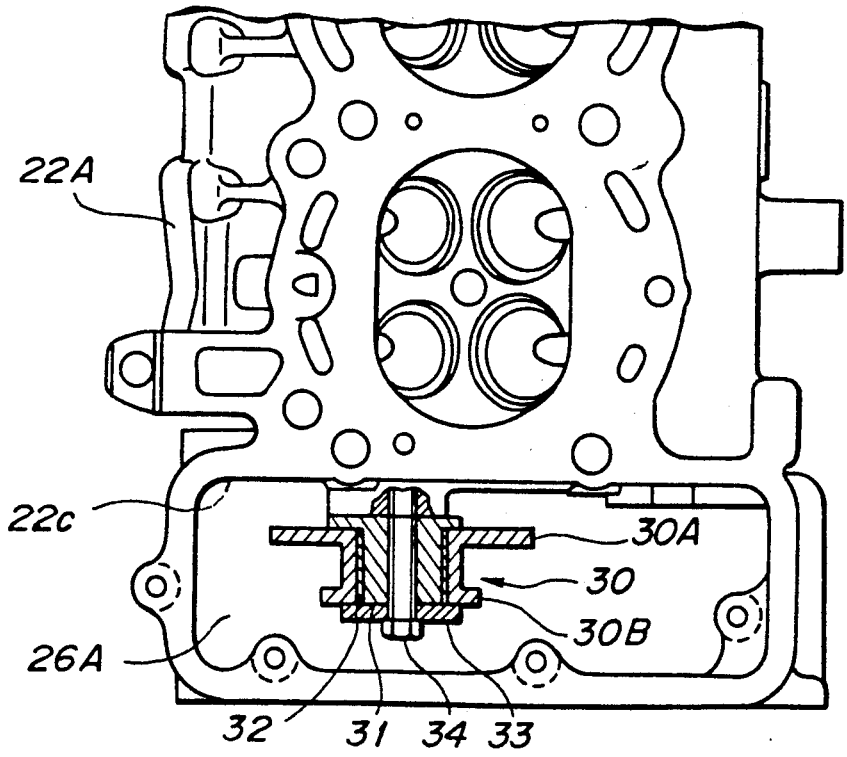
FIG. 3 is an enlarged fragmentary view of FIG. 2.

Referring first to FIGS. 1 to 3, a cylinder block 21 includes two cylinder banks 21A and 21B angularly disposed to each other. Cylinder heads 22A and 22B are mounted on the top of the cylinder banks 21A and 21B, respectively. One 21A of the two cylinder banks has a plurality of the cylinders offset from a plurality of cylinders of the other bank 21B. As best seen in FIG. 2, the cylinders 23B of the cylinder bank 21B are located nearer to the end of the cylinder block 21 than the cylinders 23A of the cylinder bank 21A are.

A crankshaft 24 is rotatably mounted at the bottom of the cylinder block 21. Two crank sprockets 25 are fixdely coupled on the crankshaft 24 on the end portion thereof. The cylinder banks 21A and 21B include chain chambers 21c and 21D, respectively.

At the longitudinal ends of the cylinder heads 22A and 22B, sprocket chambers 26A and 26B are formed, each being laterally salient and including upper, lower and lateral openings. An intake camshaft 27 and an exhaust camshaft 28 are rotatably mounted to each of the cylinder heads 22A and 22B at the top thereof. The intake camshaft 27 is provided for cyclically opening and closing intake valves (not shown), and the exhaust camshaft 28 for cyclically opening and closing exhaust valves (not shown). In each of the sprocket chambers 26A and 26B, there is provided a cam sprocket 29 mounted at the end of each of the camshafts 27 and 28.

Two idler gears 30 are rotatably mounted to the cylinder heads 22A and 22B, respectively, at the lower portion thereof. Each of the idler gears 30 includes a large gear 30A and a small gear 30B which are constructed in monoblock. As shown in FIG. 3, the idler gear 30 is rotatably mounted to a frame 31 through a bearing 32. The frame 31 is attached to an internal wall 22c of each of the sprocket chambers 26A and 26B by a locking bolt 34 with a washer 33. The large gear 30A of the idler gear 30 is so arranged as to be located adjacent the internal wall 22c of each of the sprocket chambers 26A and 26B. As best seen in FIG. 2, sprocket covers 35A and 35B are secured to open ends of lateral walls 22e of the cylinder heads 22A and 22B respectively, each being in the form of a plate which covers the opening 22d of each of the sprocket chambers 26A and 26B.

A first timing chain 36A drivingly interconnects the large gear 30A of one of the idler gears 30 and one of the crank sprockets 25, whereas a second timing chain 36B the large gear 30A of the other idler gear 30 and the other crank sprocket 25. At each of the cylinder heads 22A and 22B, one of the camshaft driving chains 37 drivingly interconnects the adjacent two cam sprockets 29 and the small gear 30B of one of the idler gears 30. The first and second timing chains 36A and 36B serve as crank chains.

The first timing chain 36A and the second timing chain 36B are disposed in different running planes which are axially distant along the axis of the crankshaft 24. Additionally, each of the running planes of the camshaft driving chains 37 of the sprocket chambers 26A and 26B is substantially equidistant from the idler gear 30 of each of the cylinder banks 21A and 21B, and it is positioned on the opposite side of the cylinder block 21 with respect to the idler gear 30. Accordingly, the running plane of the one camshaft driving chain 37 of the sprocket chamber 26B is more distant from the axial end of the cylinder block 21 than that of the other camshaft driving chain 37 of the sprocket chamber 26A.

Figure 4:
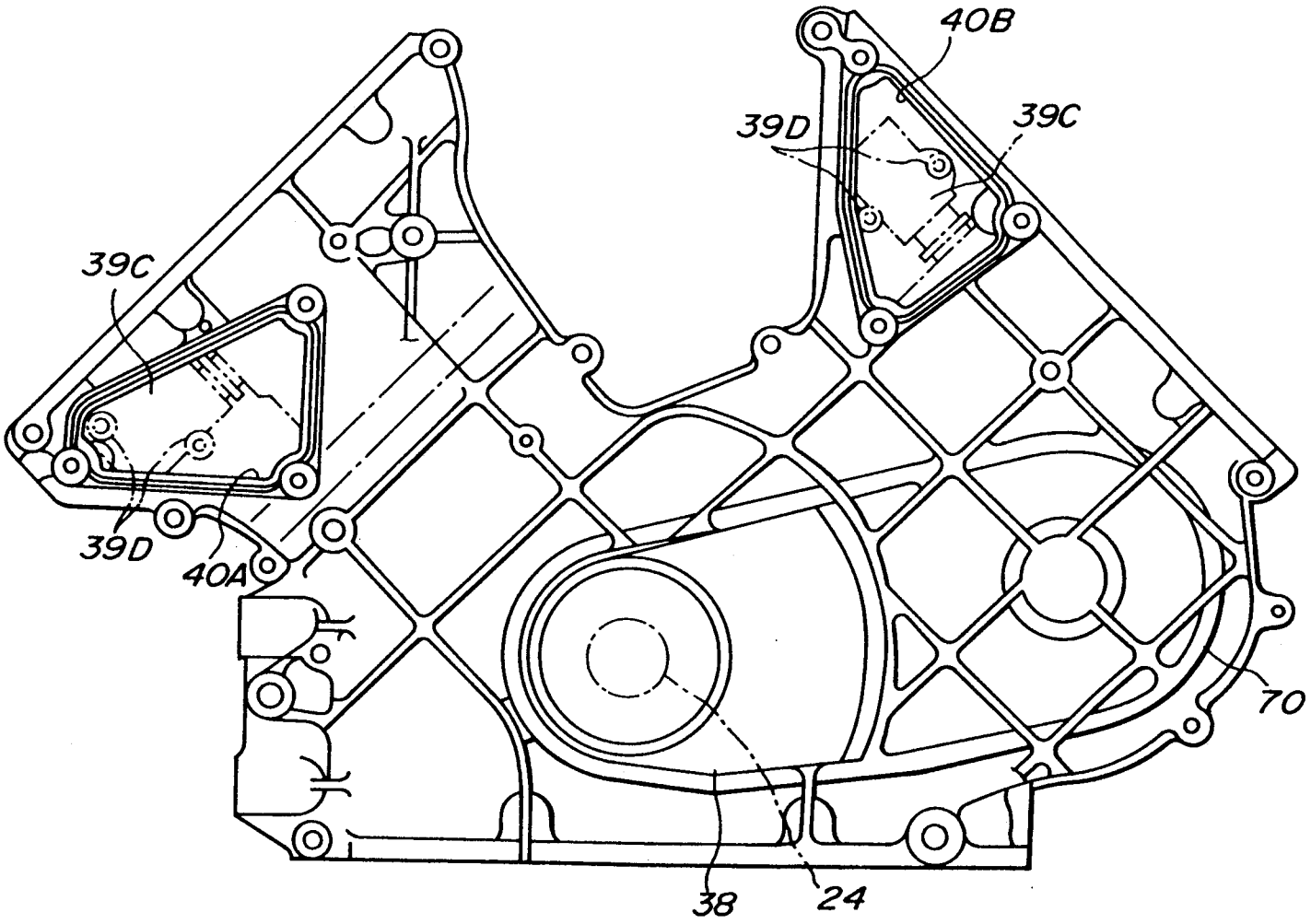
FIG. 4 is a plan view of a front cover.

In order to cover the first and second timing chains 36A and 36B, a single aluminum front cover 38 is securely attached to the cylinder block 21 at an open end of a lateral wall 21a (see FIG. 2). At the top of each of the cylinder heads 22A and 22B, there is provided a cam cover (not shown) which covers the intake and exhaust camshafts 27 and 28. Movable tensioners 39 are mounted to the cylinder block 21 for adjusting the tensions of the first and second timing chains 36A and 36B, respectively. Each of the movable tensioners 39 includes an arm 39A which has one end swingably mounted to the cylinder block 21, and a tensioner body 39C which is provided with a presser 39B for urging the other end of the arm 39A toward the timing chain 36A or 36B. The tensioner body 39C includes a locking bolt 39D for releasing the application of tension to the chain 36A or 36B. As shown in FIG. 4, the front cover 38 is formed with openings 40A and 40B positioned opposite to the tensioner bodies 39C. The openings 40A and 40B are tightly concealed by covers (not shown), respectively.

Movable tensioners 41 are arranged in the sprocket chambers 26A and 26B of the cylinder heads 22A and 22B, respectively. Each of the movable tensioners 41 adjusts the tension of the camshaft driving chain 37 by way of a presser 41A, and includes a locking bolt 41B for releasing the application of tension to the chain 37. Lateral openings 22d of the sprocket chambers 26A and 26B extend to portions opposite to the movable tensioners 41. The lateral openings 22d are greatly larger in size than the openings 40A and 40B of the front cover 38.

The gear ratio of the crank sprocket 25, the large and small gears 30A and 30B of the idler gear 30, and the cam sprocket 29 is so determined that two rotations of the crank shaft 24 cause the intake and exhaust camshafts 27 and 28 to rotate once. Note that covers 35A, 35B, and 38 are removed in FIG. 1. There are also provided fixed tensioners 42A and 42B, gaskets 43A and 43B, and a cover 70 which conceals a chain (not shown) for drivingly interconnecting a sprocket of the crankshaft 24 and an oil pump (not shown).

With such a structure, rotation of the crankshaft 24 is transmitted to the large gear 30A of each of the idler gears 30 through the first and second timing chains 36A and 36B. Sebsequently, the rotation of the crankshaft 24 is transmitted from the small gears 30B to the intake and exhaust camshafts 27 and 28 through the camshaft driving chains 37 and cam sprockets 29, cyclically opening and closing intake and exhaust valves.

As shown in FIG. 4, the openings 40A and 40B of the front cover 38 are positioned opposite to the bodies 39C of the movable tensioners 39, respectively, so that the locking bolts 39D are easy to release or remove from the outside through the openings 40A and 40B. The openings 40A and 40B therefore allow easy mounting and removing of the first and second timing chains 36A and 36B, resulting in increased efficiency in assembly.

Further, since the lateral openings 22d of the sprocket chambers 26A and 26B extend to the portions opposite to the movable tensioners 41, respectively, the locking bolts 41B are easy to release or remove from the outside through the lateral openings 22d. The openings 22d therefore allow easy mounting and removing of the camshafts 27 and 28, the cam sprockets 29, and the camshaft driving chains 37, resulting in increased efficiency in assembly.

Furthermore, since the lateral openings 22d of the sprocket chambers 26A and 26B are greatly larger in size than the openings 40A and 40B of the front cover 38, it is easy to mount the idler gears 30 by the locking bolt 34 on the internal walls 22c of the cylinder heads 22A and 22B through the lateral openings 22d, and to assemble and inspect the idler gears 30, the movable tensioners 41, and the camshaft driving chains 37, resulting in prevention of assembly error and improvement in visibility.

Figure 5:
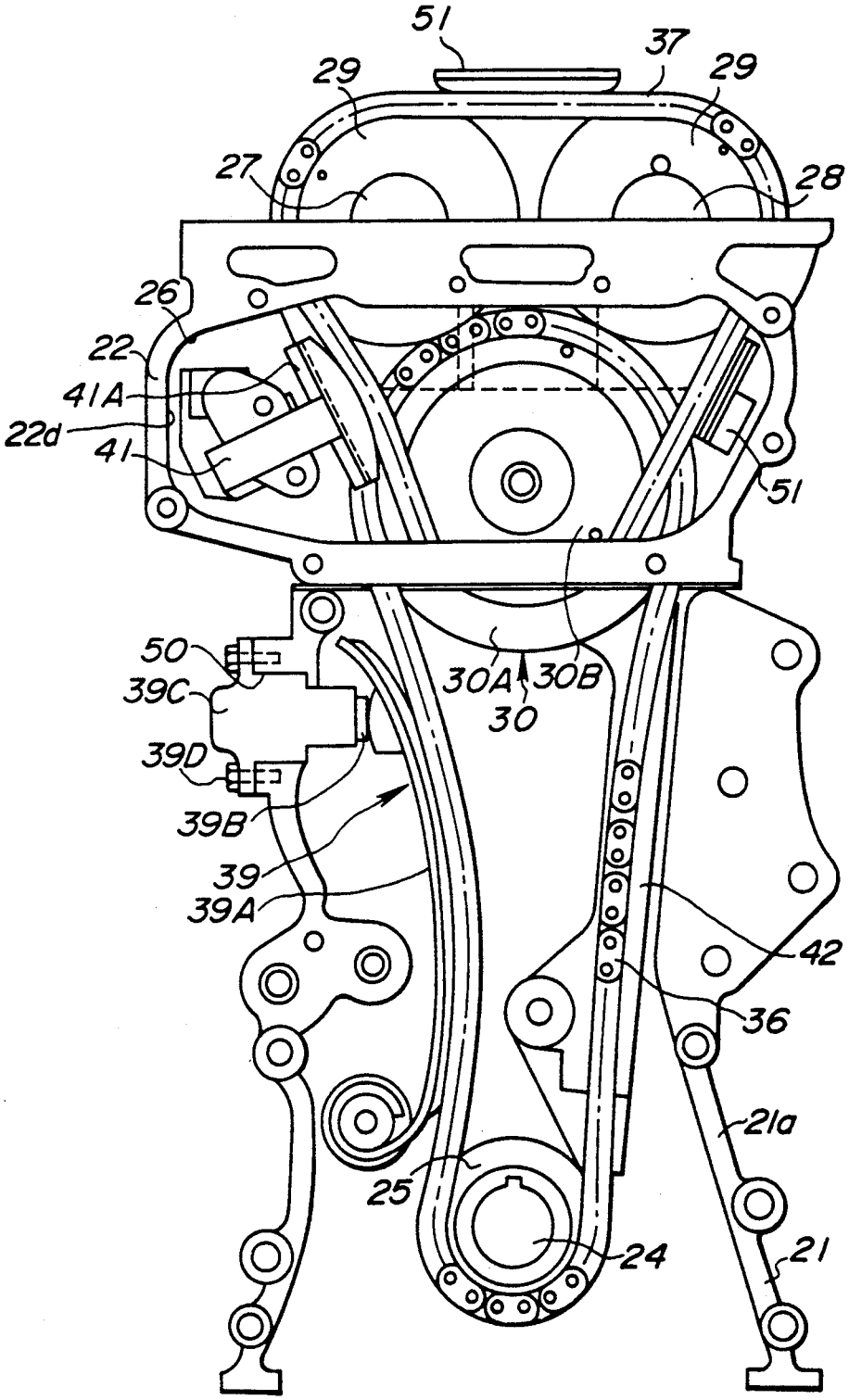
FIG. 5 is a similar view to FIG. 1 showing a second embodiment.
Figure 6:
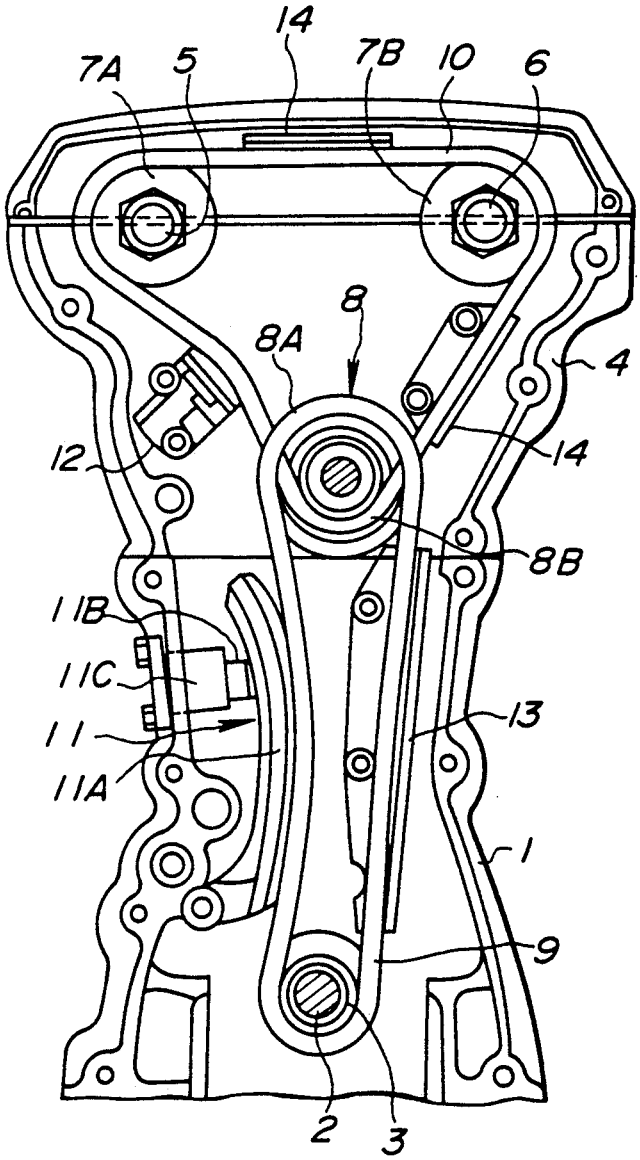
FIG. 6 (PRIOR ART)
FIG. 6 is a diagrammatic view illustrating a camshaft driving arrangement of the prior art discussed before.

Referring to FIG. 5, a second preferred embodiment of the present invention will be described. This embodiment is substantially the same as the first embodiment.

FIG. 5 shows a DOHC engine including a single cylinder head 22 on a cylinder block 21. A sprocket chamber 26 is formed with a lateral opening 22d on the side of the cylinder head 22. For adjusting the tension of a camshaft driving chain 37, a movable tensioner 41 is arranged in the sprocket chamber 26. On the other hand, for adjusting the tension of a timing chain 36, a movable tensioner 39 is mounted to the cylinder block 21. A bore 50 is perforated through a lateral wall of the cylinder block 21. The tensioner body 39C for swinging an arm 39A is secured in the bore 50 with a locking bolt 39D. There are also provided fixed tensioners 36 and 51 of the timing chain 36 and the camshaft driving chain 37.

In this embodiment, the bore 50 is formed in the cylinder block 21 instead of the openings 40A and 40B of the front cover 38 in the first embodiment. The bore 50 assumes the same effect as the openings 40A and 40B.

What is claimed is:

1. In a DOHC engine having a cylinder block including at least one cylinder bank, a cylinder head mounted on each of the at least one cylinder bank, a pair of camshafts rotatably mounted on the cylinder head, and a crankshaft, further comprising:

a pair of cam sprockets respectively mounted to the pair of camshafts on one end thereof;

a sprocket chamber formed on the cylinder head at one end thereof, said sprocket chamber being formed with a lateral opening, said sprocket chamber receiving said pair of cam sprockets;

an idler gear rotatably mounted to the cylinder head;

a timing chain drivingly interconnecting the crankshaft and said idler gear;

a camshaft driving chain drivingly interconnecting said idler gear and said pair of cam sprockets;

a first tensioner mounted to the cylinder block, said first tensioner adjusting the tension of said timing chain;

a second tensioner mounted to a wall defining in part said sprocket chamber, said second tensioner adjusting the tension of said camshaft driving chain; and means defining an access to said first tensioner, said access defining means including a front cover detachably mounted to the cylinder block to conceal said timing chain and formed with an opening positioned opposite to said first tensioner.

2. A DOHC engine as claimed in claim 1, wherein said lateral opening of said sprocket chamber is larger in size than said opening of said front cover.

3. In a DOHC engine having a cylinder block including at least one cylinder bank, a cylinder head mounted on each of the at least one cylinder bank, a pair of camshafts rotatably mounted on the cylinder head, and a crankshaft, further comprising:

a pair of cam sprockets respectively mounted to the pair of camshafts at one end thereof;

a sprocket chamber formed on the cylinder head at one end thereof, said sprocket chamber being formed with a lateral opening, said sprocket chamber receiving said pair of cam sprockets;

an idler gear rotatably mounted to the cylinder head;

a timing chain drivingly interconnecting the crankshaft and said idler gear;

a camshaft driving chain drivingly interconnecting said idler gear and said pair of cam sprockets;

a first tensioner mounted to the cylinder block, said first tensioner adjusting the tension of said timing chain;

a second tensioner mounted to a wall defining in part said sprocket chamber, said second tensioner adjusting the tension of said camshaft driving chain; and a front cover detachably mounted to the cylinder block, said front cover concealing said timing chain, said front cover being formed with an opening, said opening being position opposite to said first tensioner, said opening being smaller in size than said lateral opening of said sprocket chamber.

4. In a DOHC engine having a cylinder block bifurcating into two cylinder banks, a cylinder head mounted on each cylinder bank, a pair of camshafts rotatably mounted on each cylinder head, and a crankshaft, further comprising:

a pair of cam sprockets respectfully mounted to each pair of camshafts at one end thereof;

a sprocket chamber formed on each cylinder head at one end thereof, each sprocket chamber being formed with a lateral opening, each sprocket chamber receiving said pair of cam sprockets;

an idler gear rotatably mounted to each cylinder head;

a timing chain drivingly interconnecting the crankshaft and each of said idler gears;

a camshaft driving chain drivingly interconnecting each of the idler gears and the respective pair of cam sprockets;

a pair of first tensioners mounted to the cylinder block, each first tensioner adjusting the tension of one of said timing chains, respectively;

a pair of second tensioners, each being mounted to a wall defining in part one of said sprocket chambers, each second tensioner adjusting the tension of one of said camshaft driving chains, respectively; and a front cover detachably mounted to the cylinder block, said front cover concealing said timing chains, said front cover being formed with two openings, said openings being positioned opposite to said first tensioners, respectively, said openings being smaller in size than said lateral openings of said sprocket chamber, respectively.

* * * * *